US011801540B2

(12) United States Patent
Fürst et al.

(10) Patent No.: US 11,801,540 B2
(45) Date of Patent: Oct. 31, 2023

(54) MILL STAND

(71) Applicant: Primetals Technologies Austria GmbH, Linz (AT)

(72) Inventors: Heinz Fürst, Gallneukirchen (AT); Franz Hermann Glaser, Haid bei Ansfelden (AT); Simon Grosseiber, Leonding (AT); Georg Keintzel, Steyregg (AT); Thomas Lengauer, Weißkirchen a.d. Traun (AT); Alois Seilinger, Linz (AT); Armin Stumbauer, Freistadt (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 1 day.

(21) Appl. No.: 17/744,789

(22) Filed: May 16, 2022

(65) Prior Publication Data

US 2022/0379359 A1 Dec. 1, 2022

(30) Foreign Application Priority Data

May 28, 2021 (EP) ..... 21176501

(51) Int. Cl.
*B21B 13/22* (2006.01)

(52) U.S. Cl.
CPC ..... *B21B 13/22* (2013.01)

(58) Field of Classification Search
CPC ..... B21B 13/14; B21B 13/145; B21B 29/00; B21B 37/40; B21B 37/68
See application file for complete search history.

(56) References Cited

U.S. PATENT DOCUMENTS

2011/0302976 A1 12/2011 Keintzel

FOREIGN PATENT DOCUMENTS

| | | | | |
|---|---|---|---|---|
| AT | 507087 A4 | 2/2010 | | |
| EP | 0506138 A1 | 9/1992 | | |
| EP | 2277638 A1 | 1/2011 | | |
| JP | 01180708 A * | 7/1989 | ..... | B21B 13/145 |
| WO | WO 2008/001466 A1 | 1/2008 | | |

OTHER PUBLICATIONS

European Search Report dated Nov. 25, 2021 in corresponding European Patent Application No. 21176501.1.

* cited by examiner

*Primary Examiner* — Debra M Sullivan
(74) *Attorney, Agent, or Firm* — OSTROLENK FABER LLP

(57) ABSTRACT

A device for stabilizing of working rollers and back-up rollers of a mill stand that has, for each bending block, first hydraulic pressing units being arranged upstream of the working roller, each first hydraulic pressing unit having a piston with a piston rod and a pressure plate, the piston and the piston rod being integrated in the bending block and the pressure plate being pressable against a working roller chock, and for each stand column, at least one second hydraulic pressing unit, the second hydraulic pressing unit being arranged downstream of the back-up roller and having a piston with a piston rod and a pressure plate, the piston and the piston rod being integrated in the stand column and the pressure plate being pressable against the back-up roller chock, and a first hydraulic pressing unit containing a first oscillation absorber.

16 Claims, 7 Drawing Sheets

MILL STAND

CROSS-REFERENCE TO RELATED APPLICATIONS

The present application claims priority of European Patent Application No. 21176501.1, filed May 28, 2021, the contents of which are incorporated by reference herein.

Stabilization of the working rollers and back-up rollers of a mill stand while a rolling stock is being hot rolled to form a strip in the mill stand

TECHNICAL FIELD

The present invention relates to the technical field of rolling mill technology, specifically the rolling, preferably the hot rolling, of a rolling stock, preferably made of steel, to form a strip in a mill stand.

During rolling in a mill stand, the thickness of the rolling stock is reduced in the rolling gap between two working rollers. In the case of what is known as a "4-high" mill stand, the working rollers are supported on back-up rollers. In the case of what is known as a "6-high" mill stand, the working rollers are supported on intermediate rollers and the intermediate rollers on back-up rollers. Typically, the intermediate and back-up rollers are located below and above, respectively, the working rollers in the vertical direction. The back-up rollers are preferably hydraulic, the hydraulic cylinder being supported on a mill stand housing of the mill stand.

To guide the working, intermediate and back-up rollers, the mill stand contains working roller chocks, if appropriate intermediate roller chocks, and back-up roller chocks. In addition, the working, intermediate and back-up rollers are rotatably mounted in the working, intermediate and back-up chocks, respectively.

On the one hand, the invention relates to a mill stand, preferably a hot-rolling mill stand, having a device for stabilizing the working rollers and back-up rollers of the mill stand while a rolling stock is being rolled to form a strip, the mill stand comprising

- an upper and a lower working roller for rolling the rolling stock to form a strip,
- an upper and a lower back-up roller for supporting the working rollers in the mill stand,
- an operator-side and a drive-side mill stand housing,
- an operator-side and a drive-side working roller chock, the working rollers being rotatably mounted in the working roller chocks,
- operator-side and drive-side bending blocks for deflecting the working rollers,
- an operator-side and a drive-side back-up roller chock, the back-up rollers being rotatably mounted in the back-up roller chocks,
- for each bending block, a first hydraulic pressing unit for stabilizing the working rollers in the mill stand housing, the first hydraulic pressing units being arranged upstream of the working roller in the transport direction of the rolling stock, each first hydraulic pressing unit comprising a piston with a piston rod and a pressure plate, the piston and the piston rod being integrated in the bending block and the pressure plate being able to be pressed hydraulically against the working roller chock, and
- for each mill stand housing, a second hydraulic pressing unit for stabilizing the back-up rollers in the mill stand housing, the second hydraulic pressing unit being arranged downstream of the back-up roller in the transport direction of the rolling stock, the second hydraulic pressing unit comprising a piston with a piston rod and a pressure plate, the piston and the piston rod being integrated in the mill stand housing and the pressure plate being able to be pressed hydraulically against the back-up roller chock.

On the other hand, the invention relates to a method for stabilizing the working rollers and back-up rollers of a mill stand, preferably a hot-rolling mill stand, while a rolling stock is being rolled, preferably hot rolled, to form a strip in the mill stand, comprising the following method step:

- setting a rolling gap in the vertical direction between the lower and the upper working roller.

PRIOR ART

Mill stands, and the setting of a rolling gap in the vertical direction between the lower and the upper working roller before a rolling stock is rolled, preferably hot rolled, to form a strip in the mill stand are known from the prior art.

In both hot and cold rolling mills, under certain production conditions, externally or intrinsically excited stand oscillations occur. It has been found that stand oscillations occur if anything in the case of high thickness reduction rates and high rolling speeds. Consequently, stand oscillations occur in particular in rolling mills operating with high productivity.

EP 506 138 A1 discloses a mill stand of the generic type, having two bending blocks on the run-in side and two bending blocks on the run-out side for each mill stand housing. Each bending block comprises a first hydraulic pressing unit (also hydraulic cylinder means or jack) for stabilizing the working roller 7, comprising a piston rod 10 and a piston 10*a*, with the result that a pressure plate formed in one piece with the bending block can be pressed hydraulically against the working roller chock 16. Moreover, the mill stand comprises second hydraulic pressing units 19 which are arranged on the run-out side and are intended for stabilizing the back-up rollers 8, each comprising a piston rod and a piston, with the result that a pressure plate 18 can be pressed hydraulically against the back-up roller chock 17.

WO 2008/001466 A1 discloses a mill stand having bending blocks on the run-in side for each mill stand housing. Each bending block has a first hydraulic pressing unit 25, comprising a piston rod and a piston, for stabilizing the working roller 13, 14, with the result that a pressure plate 21 can be pressed hydraulically against the working roller chock 12, 13.

Tests carried out by the applicant have shown that in particular the production of thin strips (final thickness≤1 mm) on a combined casting and rolling plant, e.g. an Arvedi ESP plant, can give rise to stand oscillations in the first, second and third mill stand of the finishing train. In terms of the strip quality, stand oscillations in the third stand of the finishing train (sometimes also referred to as F3) are especially detrimental since oscillation marks can be impressed into the working rollers after several strips, as a result of which the surface quality of the finished strip is degraded. Furthermore, stand oscillations constitute additional loads for mechanical components or systems, resulting in a reduction in their service life.

The prior art does not disclose how the working rollers and back-up rollers of a mill stand can be reliably stabilized while a rolling stock is being hot rolled to form a roughed or finished strip in the mill stand.

SUMMARY OF THE INVENTION

The object of the invention consists in finding a device for stabilizing the working rollers and back-up rollers of a mill stand, preferably a hot-rolling mill stand, while a rolling stock is being rolled to form a strip in a mill stand, and finding a method for stabilizing the working rollers and back-up rollers of the mill stand, as a result of which the stand oscillations that occur can be permanently and reliably reduced. The intention of this is firstly to improve the surface quality of the strips produced and secondly to reduce the loading of the mill stand.

The device-related aspect of this object is achieved by a device as claimed in claim 1. The dependent claims relate to advantageous embodiments.

In detail, the object is achieved by a mill stand, preferably a hot-rolling mill stand, having a device for stabilizing the working rollers and back-up rollers of the mill stand while a rolling stock is being rolled to form a strip, the mill stand comprising

- an upper and a lower working roller for rolling the rolling stock to form a strip,
- an upper and a lower back-up roller for supporting the working rollers in the mill stand,
- an operator-side and a drive-side mill stand housing,
- an operator-side and a drive-side working roller chock, the working rollers being rotatably mounted in working roller chocks,
- operator-side and drive-side bending blocks for deflecting the working rollers,
- an operator-side and a drive-side back-up roller chock, the back-up rollers being rotatably mounted in back-up roller chocks, wherein

- for each bending block, there are preferably two, particularly preferably four, first hydraulic pressing units for stabilizing the working rollers in the mill stand housing, the first hydraulic pressing units being arranged upstream of the working roller in the transport direction of the rolling stock, each first hydraulic pressing unit comprising a piston with a piston rod and a pressure plate, the piston and the piston rod being integrated in the bending block and the pressure plate being able to be pressed hydraulically against a working roller chock;
- for each mill stand housing, there is at least one second hydraulic pressing unit for stabilizing the back-up rollers in the mill stand housing, the second hydraulic pressing unit being arranged downstream of the back-up roller in the transport direction of the rolling stock, the second hydraulic pressing unit comprising a piston with a piston rod and a pressure plate, the piston and the piston rod being integrated in the mill stand housing and the pressure plate being able to be pressed hydraulically against the back-up roller chock,
- it being the case that one, preferably each, first hydraulic pressing unit contains a first oscillation absorber, which reduces pressure oscillations that occur in a pressure chamber, preferably a piston-side pressure chamber, of the first hydraulic pressing unit.

The first hydraulic pressing units in the bending blocks on the run-in side brace the working roller chocks against the mill stand housings and mechanically stabilize the working roller chocks, and the working rollers rotatably mounted in the working roller chocks, in the horizontal direction in the mill stand housings of the mill stand. In this respect, the first hydraulic pressing units press typically against vertical guide surfaces of the working roller chocks, with the result that the bending blocks arranged on the run-in side are mechanically braced against the working roller chocks. The first hydraulic pressing units are arranged on the run-in side.

In a preferred embodiment, the piston rod of the first hydraulic pressing unit is supported on the bending block. This embodiment makes it possible to integrate the first hydraulic pressing unit especially compactly in the bending block.

The second hydraulic pressing units in the mill stand housings on the run-out side brace the back-up roller chocks against the mill stand housings and mechanically stabilize the back-up roller chocks, and the back-up rollers rotatably mounted in the back-up roller chocks, in the horizontal direction in the mill stand housings of the mill stand. In this respect, a second hydraulic pressing unit presses against a typically vertical guide surface of a back-up roller chock, with the result that the back-up roller chocks arranged on the run-out side are mechanically braced against the mill stand housings. The second hydraulic pressing units are arranged on the run-out side.

In a preferred embodiment, the piston rod of the second hydraulic pressing unit is supported on the mill stand housing. This embodiment makes it possible to integrate the second hydraulic pressing unit especially compactly in the mill stand housing.

The device according to the invention makes it possible to permanently and reliably reduce externally or intrinsically excited stand oscillations, in particular in the production of thin strips with high productivity, as a result of which

- the ratio of production of thin hot strips to the total production volume can be increased,
- components subjected to high degrees of loading by stand oscillations, such as bearings, toothings, roller surfaces, etc. can be protected, and
- the rolling campaigns between two working roller changes can be lengthened.

The invention is applicable both to "4-high" and to "6-high" mill stands. In addition, the invention is not restricted to combined casting and rolling plants and can be advantageously used in particular also for combined casting and rolling plants of the Arvedi ESP, CSP type from SMS or the QSP or DUE type from Danieli.

It is likewise possible that, in addition to a bending block on the run-in side with multiple first hydraulic pressing units, there is also a bending block on the run-out side with one or more first hydraulic pressing units. In addition, it is possible that a mill stand housing, in addition to one or more second hydraulic pressing units arranged on the run-out side, also has one or more second hydraulic pressing units arranged on the run-in side.

In a first embodiment of poorer quality, a bending block has only one first hydraulic pressing unit on the run-out side or multiple first hydraulic pressing units on the run-out side. In a second embodiment of poorer quality, a mill stand housing has only one second hydraulic pressing unit on the run-in side. In a third embodiment of poorer quality, a back-up roller chock does not have a second hydraulic pressing unit.

It is preferably the case that each bending block arranged on the run-in side has two or four first hydraulic pressing units, the pressing units being arranged e.g. horizontally next to one another and/or vertically one below the other.

In comparison with EP 506 138 A1, the mill stand according to the invention typically has only one bending block on the run-in side for each mill stand housing and not two, i.e. an upper and a lower bending block. It is preferable in addition if 1) the piston rod of the first hydraulic pressing unit is supported on the bending block and not on the mill stand housing, and 2) the piston rod of the second hydraulic pressing unit is supported on the mill stand housing and not on the pressure plate.

According to the invention, one, preferably each, first hydraulic pressing unit comprises a first oscillation absorber, which reduces pressure oscillations that occur in a pressure chamber, preferably a piston-side pressure chamber, of the first hydraulic pressing unit. This makes it possible additionally to hydraulically stabilize the working rollers.

It is preferably the case that one, preferably each, second hydraulic pressing unit contains a second oscillation absorber, which reduces pressure oscillations that occur in a pressure chamber, preferably a piston-side pressure chamber, of the second hydraulic pressing unit. This makes it possible additionally to hydraulically stabilize the back-up rollers.

The first and/or second oscillation absorber significantly reduce(s) the pressure oscillations that occur in the first hydraulic pressing units and/or the second hydraulic pressing units, this resulting in further stabilization of the rollers.

In a very compact embodiment, the piston rod of a first and/or second hydraulic pressing unit has two longitudinal bores, a first longitudinal bore being connected to the piston-side pressure chamber and a second longitudinal bore being connected to the rod-side pressure chamber.

In addition, it is expedient if the piston and the piston rod are connected fixedly to the bending block and mill stand housing, respectively. In this case, it is not the piston or the piston rod that moves, but what is known as the "cylinder barrel". The pressure plate is fastened to the front end of the cylinder barrel.

According to an advantageous embodiment, a first and/or second oscillation absorber is in the form of a Helmholtz resonator having a longitudinal channel forming a hydraulic inductance and a volume forming a hydraulic capacity. In this respect, a pressure chamber of the pressing unit is connected to the longitudinal channel and the longitudinal channel is connected to the volume of the Helmholtz resonator.

To set the damping of the Helmholtz resonator, it can be advantageous if the longitudinal channel has a settable throttle, e.g. a valve.

As an alternative to the Helmholtz resonator, it is possible for a first and/or second oscillation absorber also to be in the form of what is known as $\lambda/4$ resonators or spring-mass oscillators. A $\lambda/4$ resonator has a length which corresponds to one quarter of the wavelength of the characteristic natural oscillation. To reduce and/or compensate pressure oscillations in a hydraulic pressing unit, a pressure chamber of the pressing unit is connected to the $\lambda/4$ resonator.

For the best possible action of the first and/or second oscillation absorber, it is advantageous if, for the natural frequency $f_T$ of the oscillation absorber, it holds true that $0.75*f_T \leq f_C \leq 1.33*f_T$, $f_C$ being a characteristic frequency occurring in the mill stand. For example, if a frequency of 100 Hz characteristically occurs in the mill stand, the natural frequency of the oscillation absorber should be between 75 and 133 Hz.

The method-related aspect of the object according to the invention is achieved by a method as claimed. The dependent claims relate to advantageous embodiments.

Specifically, the object is achieved by a method for stabilizing the working rollers and back-up rollers of a mill stand, preferably a hot-rolling mill stand, as claimed in one of the preceding claims, while a rolling stock is being rolled, preferably hot rolled, to form a strip in the mill stand, comprising the following method steps:

- setting a rolling gap in the vertical direction between the lower and the upper working roller;
- stabilizing the working rollers by applying a first hydraulic pressure to the first hydraulic pressing units, the first hydraulic pressing units being pressed against the working roller chocks;
- stabilizing the back-up rollers by applying a second hydraulic pressure to the second hydraulic pressing units, the second hydraulic pressing units being pressed against the back-up roller chocks;
- absorbing pressure oscillations in a pressure chamber, preferably a piston-side pressure chamber, of the first hydraulic pressing units by means of multiple first oscillation absorbers, and
- absorbing pressure oscillations in a pressure chamber, preferably a piston-side pressure chamber, of the second hydraulic pressing units by means of multiple second oscillation absorbers.

According to the invention, the method proceeds as follows: Firstly, the rolling gap in the vertical direction between the upper and the lower working roller is set. Typically, the rolling gap is set by way of a hydraulic cylinder (sometimes referred to as HGC (Hydraulic Gap Control) cylinder or AGC (Automatic Gap Control)), which acts on the mill stand housing. After the rolling gap has been set, pressure is applied to the first and second hydraulic pressing units, with the result that they are pressed against the working roller chocks and the back-up roller chocks, respectively. This mechanically stabilizes the working rollers and back-up rollers of the mill stand. Then, pressure oscillations that occur in the pressure chambers, preferably the piston-side pressure chambers, of the first hydraulic pressing units and the second hydraulic pressing units are reduced by means of multiple first and second oscillation absorbers. This hydraulically stabilizes the working rollers and back-up rollers of the mill stand.

According to the invention, it is likewise possible for pressure to continue to be applied to the working rollers and back-up rollers in particular during continuous operation in what is known as "Flying Gauge Change", although the run-out thickness of the strip is changed during the uninterrupted operation.

On a hot-strip train during batch operation, in which a leading pass with a new strip is always made from strip to strip, it is advantageously the case that, before the leading pass, the chock is pressed against the column with a higher force and the pressing force is reduced immediately after the leading pass.

The mill stand preferably carries out an nth rolling pass in a finishing train, the first and second oscillation absorbers being set to a natural frequency of between $f_{Low}$ and $f_{High}$

| nth rolling pass | $f_{Low}$ [Hz] | $f_{High}$ [Hz] |
|---|---|---|
| 1 | 22 | 40 |
| 2 | 48 | 87 |
| 3 | 75 | 133 |

In particular in the case of finish rolling in a finishing train (also referred to as multiple-stand tandem finishing train), stand oscillations have a very detrimental effect on the surface quality of the finished strip, and therefore reducing the stand oscillations and/or stabilizing the working rollers and back-up rollers has an especially advantageous effect.

During operation of the first hydraulic pressing units, it is advantageous if a first pressing unit can apply a clamping force that can be regulated as required and a stroke of between 4 and 8 mm. During operation of the second hydraulic pressing units, it is advantageous if a second pressing unit can apply a clamping force that can be regulated as required and a stroke of between 4 and 8 mm.

The clamping force of a first hydraulic pressing unit is preferably set during operation by way of a pressure regulator with a continuously adjustable valve.

The clamping force of a second hydraulic pressing unit is preferably set during operation by way of a pressure regulator with a continuously adjustable valve.

A pressure regulator makes it possible to set "any desired" pressures up to the system pressure. In this way, if appropriate also smaller pressures can be and are set (in order to avoid obstruction of the vertical regulating movement as best as possible).

BRIEF DESCRIPTION OF THE DRAWINGS

The above-described properties, features and advantages of the present invention and the manner in which they are achieved will become clearer and more clearly understandable in connection with the following description of multiple drawings, in which.

DESCRIPTION OF THE EMBODIMENTS

Figure 1:
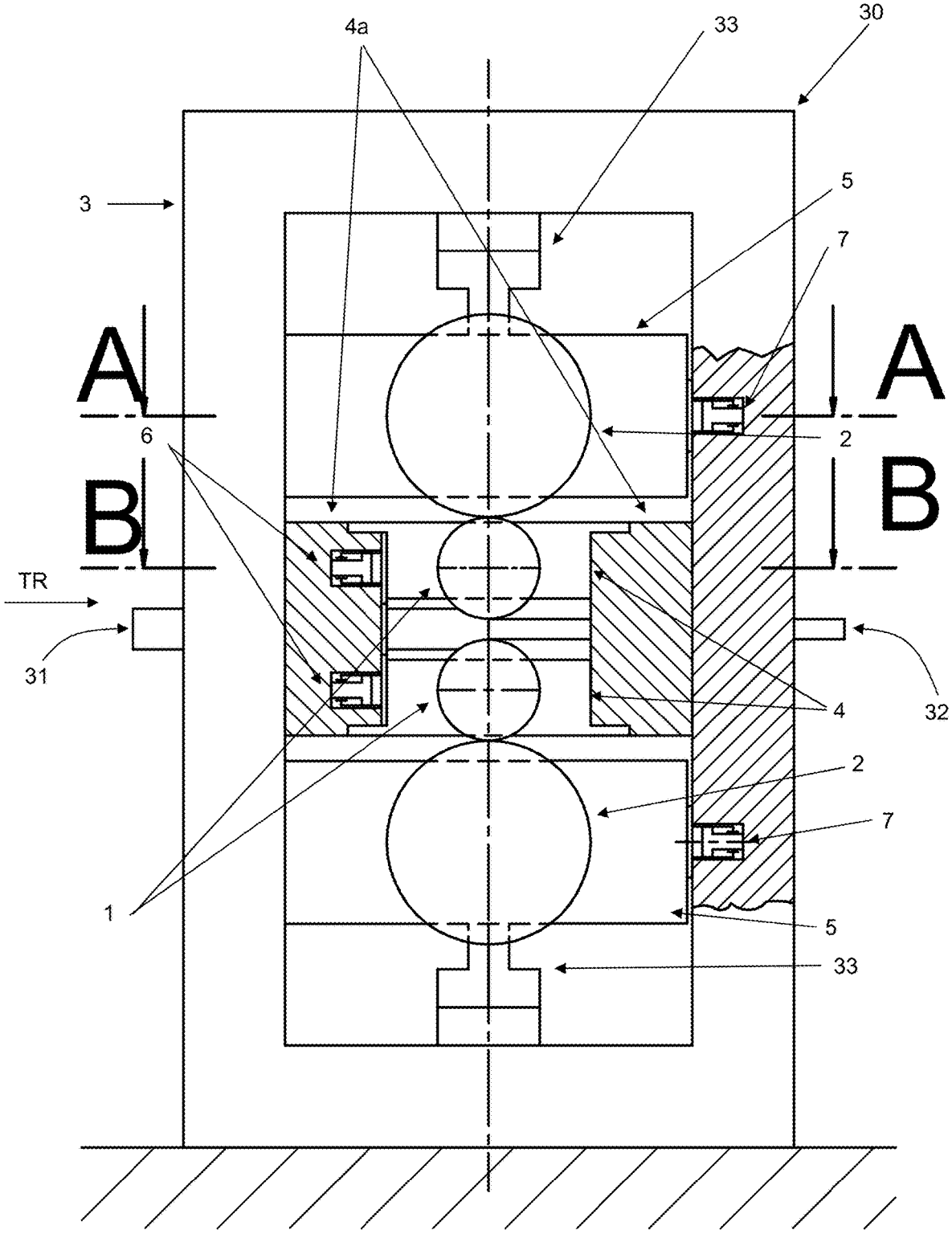
FIG. 1 shows a partial sectional front view of a mill stand with a device for stabilizing the working rollers and back-up rollers.

FIG. 1 schematically shows a front view of a mill stand 30, specifically the third hot-mill stand F3, of a finishing train of an Arvedi ESP plant. The rolling stock 31 of steel is hot rolled to form a strip 32 in the rolling gap between the working rollers 1 of the mill stand 30. Each working roller 1 is rotatably mounted in two working roller chocks 4. The working rollers 1 are supported on back-up rollers 2. It is also the case that each back-up roller 2 is rotatably mounted in two back-up roller chocks 5. The working roller chocks 4 and the back-up roller chocks 5 are displacable in the vertical direction in the mill stand housings 3. The rolling gap between the two working rollers 1 is set by at least one hydraulic cylinder 33. The working rollers 1 can be deflected by way of the bending blocks 4*a*, which are arranged between the mill stand housings 3 and the working roller chocks 4. This makes it possible, among other things, to change the profile and/or the evenness of the rolled strip 32. Bending blocks are known in principle from the prior art. In order to enhance clarity, in FIGS. 1 and 3 the bending blocks 4*a* are illustrated without the hydraulic cylinders for deflecting the working rollers 1. To reduce stand oscillations in the mill stand 3 or to stabilize the working rollers 1 and the back-up rollers 2 while the rolling stock 31 is being rolled to form the strip 32, the first hydraulic pressing units 6 are pressed against the working roller chocks 4. The first hydraulic pressing units 6 are integrated in the bending block 4*a* illustrated on the left-hand side and are arranged on the run-in side with respect to the transport direction TR of the rolling stock 31. The second hydraulic pressing units can be pressed against the back-up roller chocks 5. The second hydraulic pressing units 7 are integrated in the mill stand housing 3 and are arranged on the run-out side with respect to the transport direction TR of the rolling stock 31.

Figure 2:
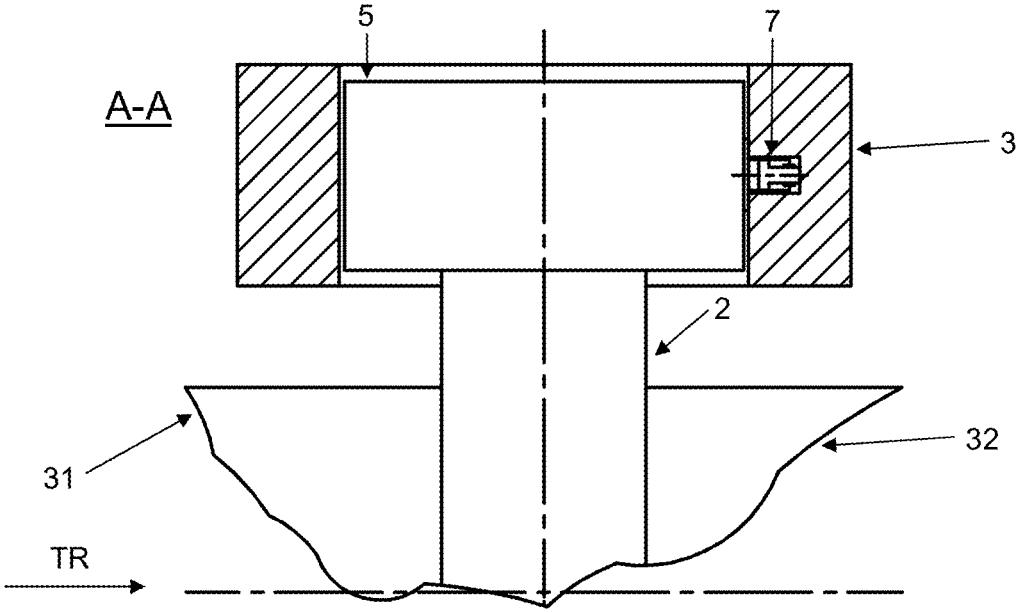
FIG. 2 shows a partially sectional illustration along the line A-A from FIG. 1.
Figure 3:
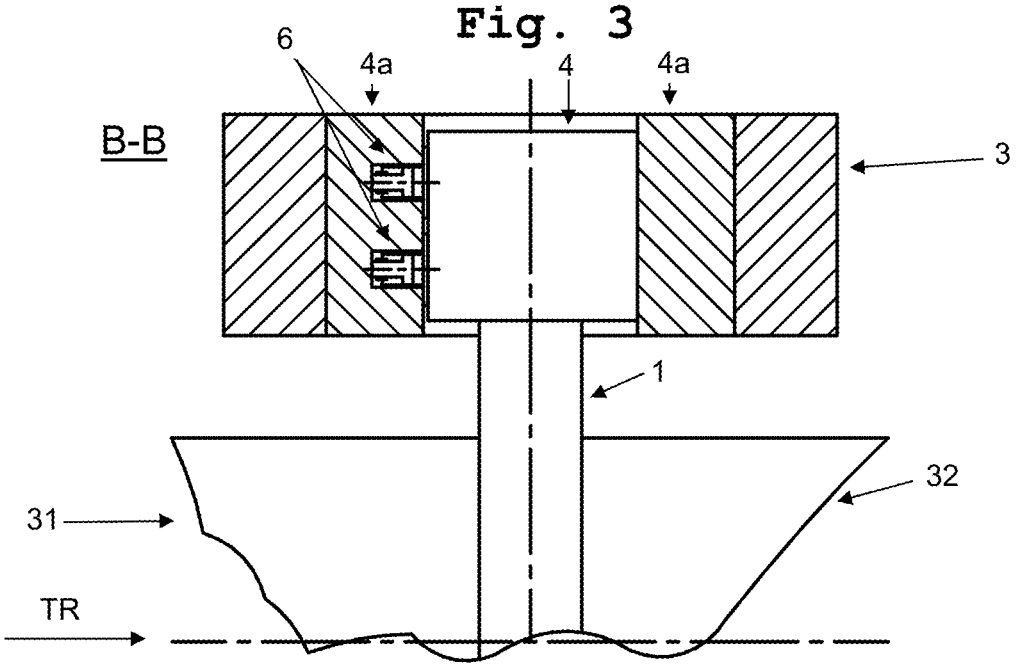
FIG. 3 shows a partially sectional illustration along the line B-B from FIG. 1.

FIGS. 2 and 3 respectively show a partial sectional illustration along the sectional line A-A (FIG. 2) and along the sectional line B-B (FIG. 3).

It is clear from FIG. 2 that the back-up roller 2 is mounted in the mill stand housings 3 by way of two back-up roller chocks 5. The back-up roller chocks 5 can be braced against the mill stand housings 3 by the second hydraulic pressing units 7. The second hydraulic pressing units 7 mechanically stabilize the back-up rollers 2.

In a similar way, FIG. 3 shows that the bending blocks 4*a* can be braced against the working roller chocks 4 by two respective first hydraulic pressing units 6. The first hydraulic pressing units 6 mechanically stabilize the working rollers 1.

Figure 4:
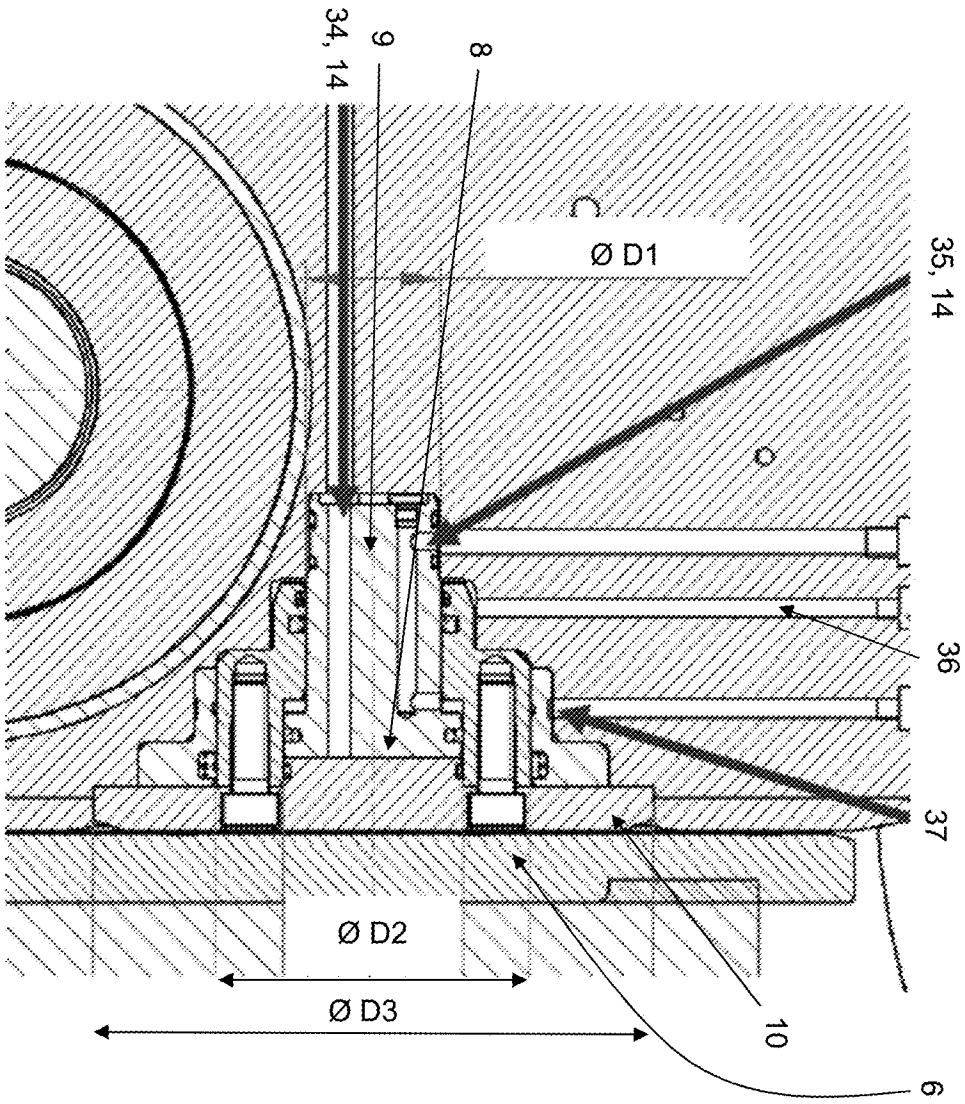
FIG. 4 shows a sectional illustration of a working roller chock with a first hydraulic pressing unit.

FIG. 4 shows a sectional illustration of a first hydraulic pressing unit 6. In order to be able to introduce the compressive forces of the pressure plate 10 directly into the bending block 4*a*, and for reasons of compactness, the piston rod 9 and the piston 8 of the first hydraulic pressing unit 6 are integrated in the bending block 4*a*. The piston rod 9 has for example a diameter D1 of 60 mm, the piston 8 has a diameter D2 of 80 mm and the pressure plate 10 has a diameter D3 of 250 mm. The first hydraulic pressing unit 6 has four ports: an oil supply for the piston side 34, an oil supply for the rod side 35, a leakage port 36, and a lubricant supply 37. The oil supply for the piston side 34 leads into a first longitudinal bore in the piston rod 9, which is connected to the piston-side pressure chamber of the first hydraulic pressing unit 6. The oil supply for the rod side 35 leads into a second longitudinal bore in the piston rod 9, which is connected to the rod-side pressure chamber of the first hydraulic pressing unit 6. The leakage port 36 ensures that any leakages from the first hydraulic pressing unit 6 are withdrawn. Lastly, the lubricant supply 37 ensures that the pressure plate 10 is supplied with enough lubricant. The specified dimensions of the first hydraulic pressing unit 6 serve only for illustrative purposes and are not limiting. The first hydraulic pressing unit 6 can apply a stroke of 6 mm and a maximum clamping force of 125 kN. Each bending block 4*a* on the run-in side has four first hydraulic pressing units 6 (see FIG. 5).

Except for the specified diameters D1 to D3, the specified stroke and the maximum clamping force, the structure of a second hydraulic pressing unit is identical to the structure of a first hydraulic pressing unit 6.

Figure 5:
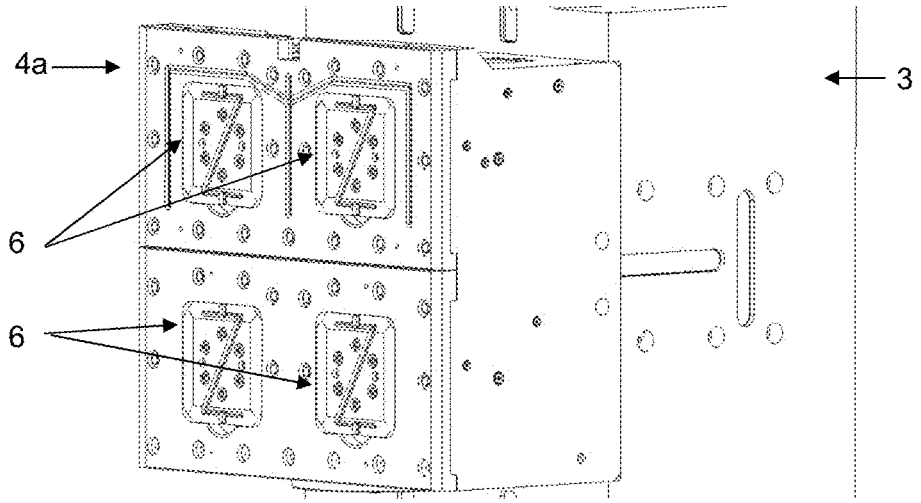
FIG. 5 shows an axonometric illustration of the bending block with four first hydraulic pressing units from FIG. 4.

FIG. 5 shows an exterior view of a bending block 4*a* with four first hydraulic pressing units 6. The bending block 4*a* is fixed to the mill stand housing 3.

Figure 6:
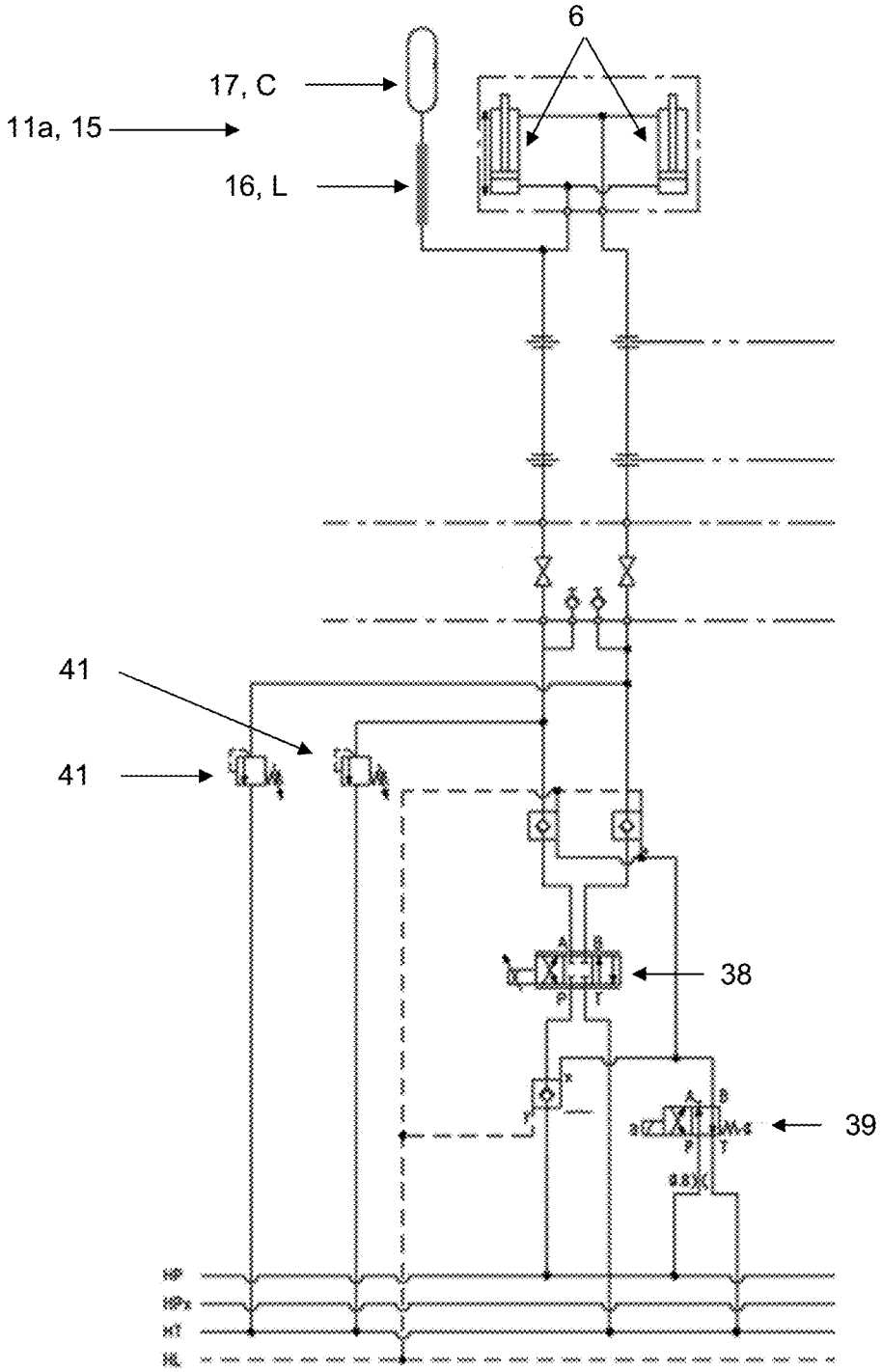
FIG. 6 shows a hydraulic layout for the first hydraulic pressing unit from FIG. 4.

FIG. 6 shows a hydraulic layout for the actuation of two first hydraulic pressing units 6, which are activated by way of a switching valve 39. The proportional/regulating or servo valve (valves of this type are also referred to as continuously adjustable valves) 38 has the function of setting a particular pressure level on the piston side of the two first hydraulic pressing units 6, with the result that a working roller chock is pressed against a working roller chock with a defined pressing force. The two pressure limiting valves 41 serve to limit the maximum pressure. Lastly, it can be seen from FIG. 6 that the piston sides of the two first hydraulic pressing units 6 are connected to a first oscillation absorber 11*a*, the oscillation absorber being in the form of a Helmholtz resonator with a hydraulic inductance L and a volume 17 as hydraulic capacity C. The natural frequency $f_T$ of a Helmholz resonator is $$f_T = \frac{1}{2\pi\sqrt{L \cdot C}},$$

such that the natural frequency $f_T$ can be easily adapted to the stand oscillations occurring during operation.

Figure 7:
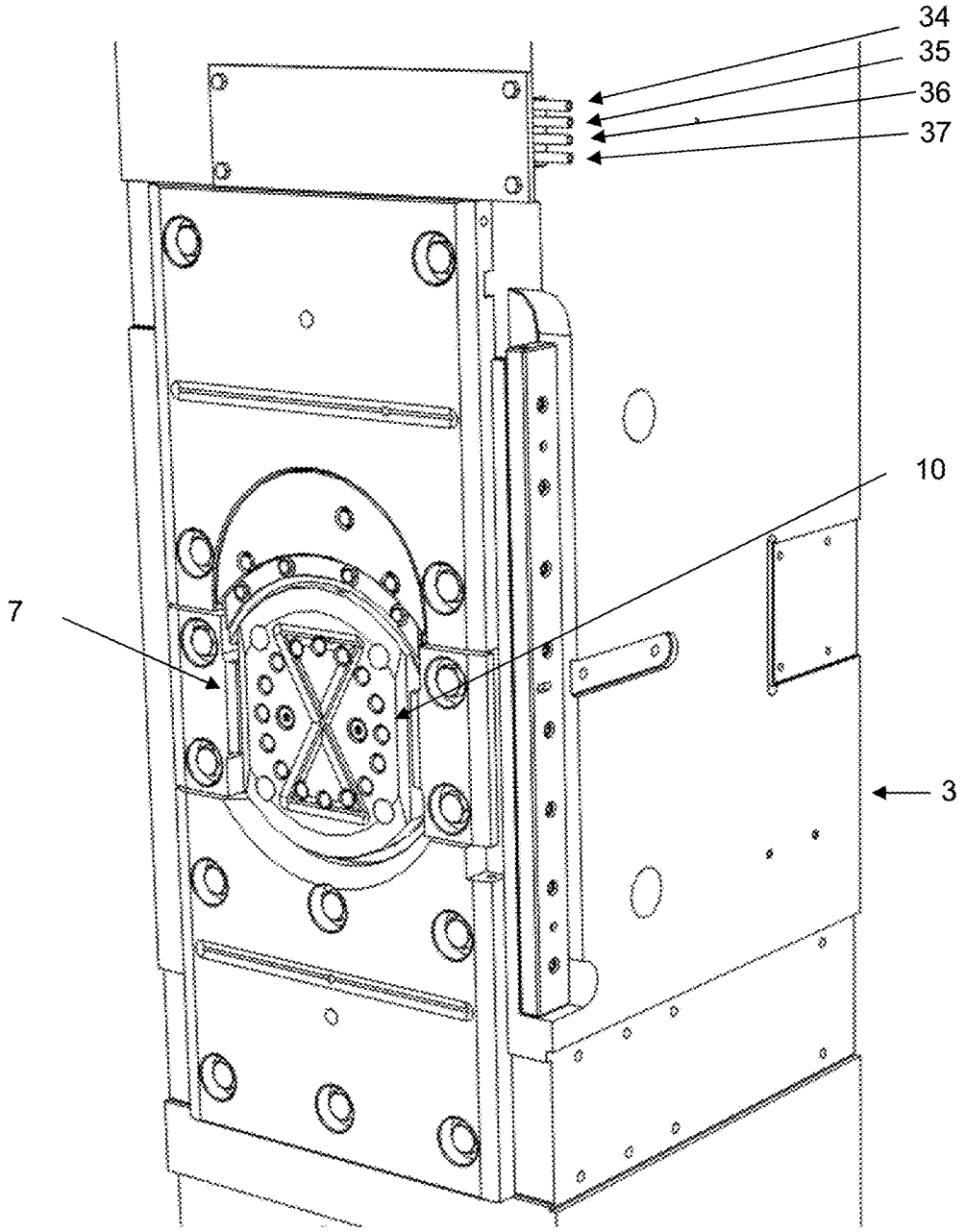
FIG. 7 shows an axonometric illustration of a mill stand housing with a second hydraulic pressing unit.

FIG. 7 shows an exterior view of a second hydraulic pressing unit 7, which is integrated in a mill stand housing 3. The piston rod has for example a diameter of 140 mm, the piston has a diameter of 160 mm and the pressure plate has a diameter of 350 mm. The second hydraulic pressing unit 7 also has four ports: an oil supply for the piston side 34, an oil supply for the rod side 35, a leakage port 36, and a lubricant supply 37. The specified dimensions of the second hydraulic pressing unit 7 serve only for illustrative purposes and are not limiting. The second hydraulic pressing unit 7 can apply a stroke of 6 mm and a clamping force of 500 kN. A second hydraulic pressing unit 7 can therefore press against a back-up roller chock 5 with a force of 500 kN.

Figure 8:
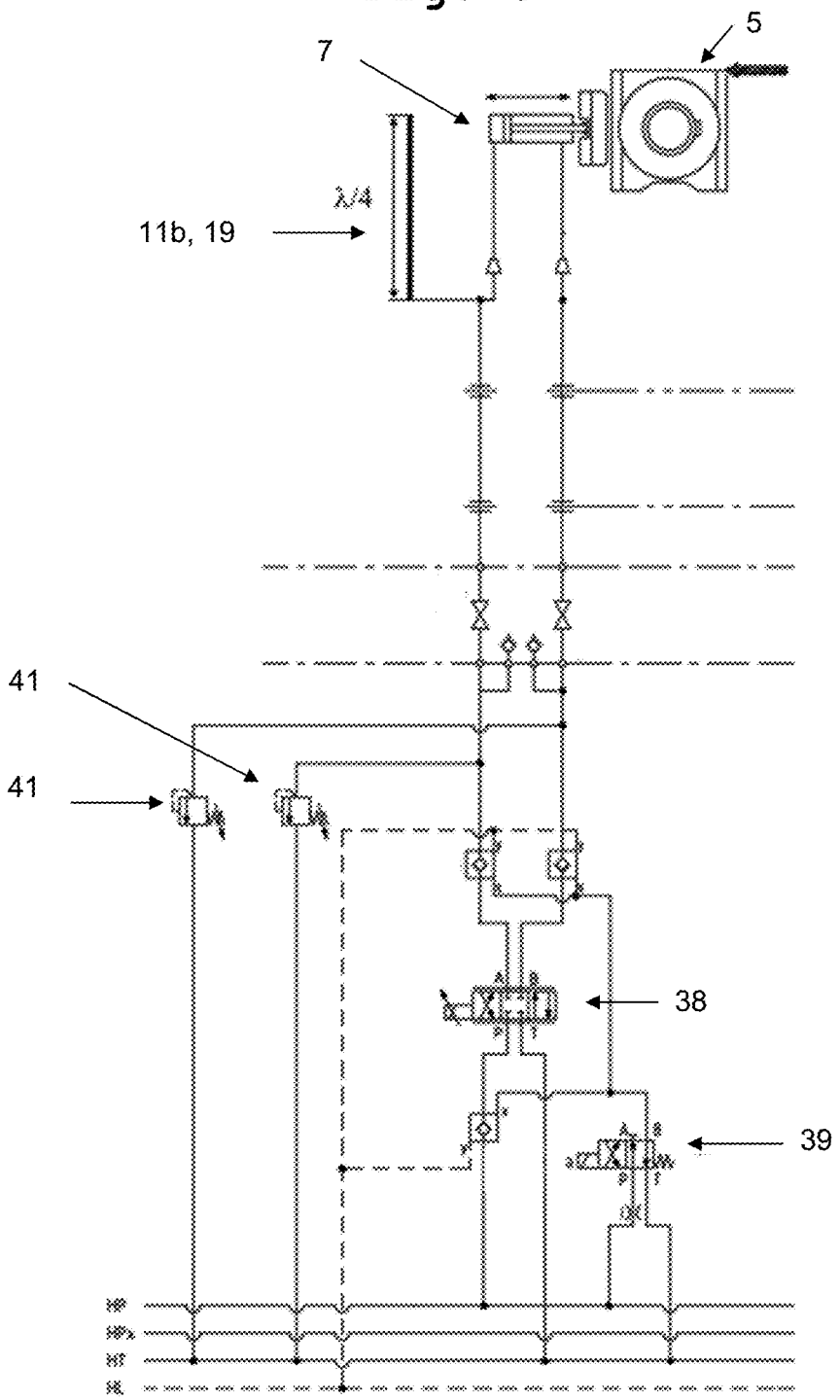
FIG. 8 shows a hydraulic layout for the second hydraulic pressing unit from FIG. 7.

FIG. 8 shows a hydraulic layout for the actuation of a second hydraulic pressing unit 7. A switching valve 39 activates the pressure supply for the proportional/regulating/servo or continuously adjustable valve 38. The proportional/regulating/servo or continuously adjustable valve 38 has the function of setting a particular pressure level on the piston side of the second hydraulic pressing unit 7, with the result that a back-up roller chock 5 is pressed against the mill stand housing with a defined pressing force. The two pressure limiting valves 41 serve to limit the maximum pressure. Lastly, it can be seen from FIG. 8 that the piston side of the second hydraulic pressing unit 7 is connected to a second oscillation absorber 11*b*, the oscillation absorber being in the form of a λ/4 resonator with a length of λ/4.

The length of the one λ/4 resonator is calculated as follows: The speed of sound $c_S$ in oil results from the formula $c_S=\sqrt{B/\rho}$, B specifying the compressive modulus and r specifying the density of the oil. In the case of oil, B is approx. 12 000 bar and r is approx. 850 kg/m$^3$. Therefore, the result is $c_S$=1188 m/s. As described above, the frequency of the stand oscillation in the third finishing stand is approx. 100 Hz. The wavelength λ of an oscillation at 100 Hz in oil is produced by $\lambda=c_S/f$=11.88 m. A λ/4 resonator therefore has a length of λ/4=2.97 m. The λ/4 resonator may be configured either as a straight tube or hose piece, as illustrated, or as a curved tube or hose piece. By way of the length, the λ/4 resonator can be adapted very easily.

Figure 9:
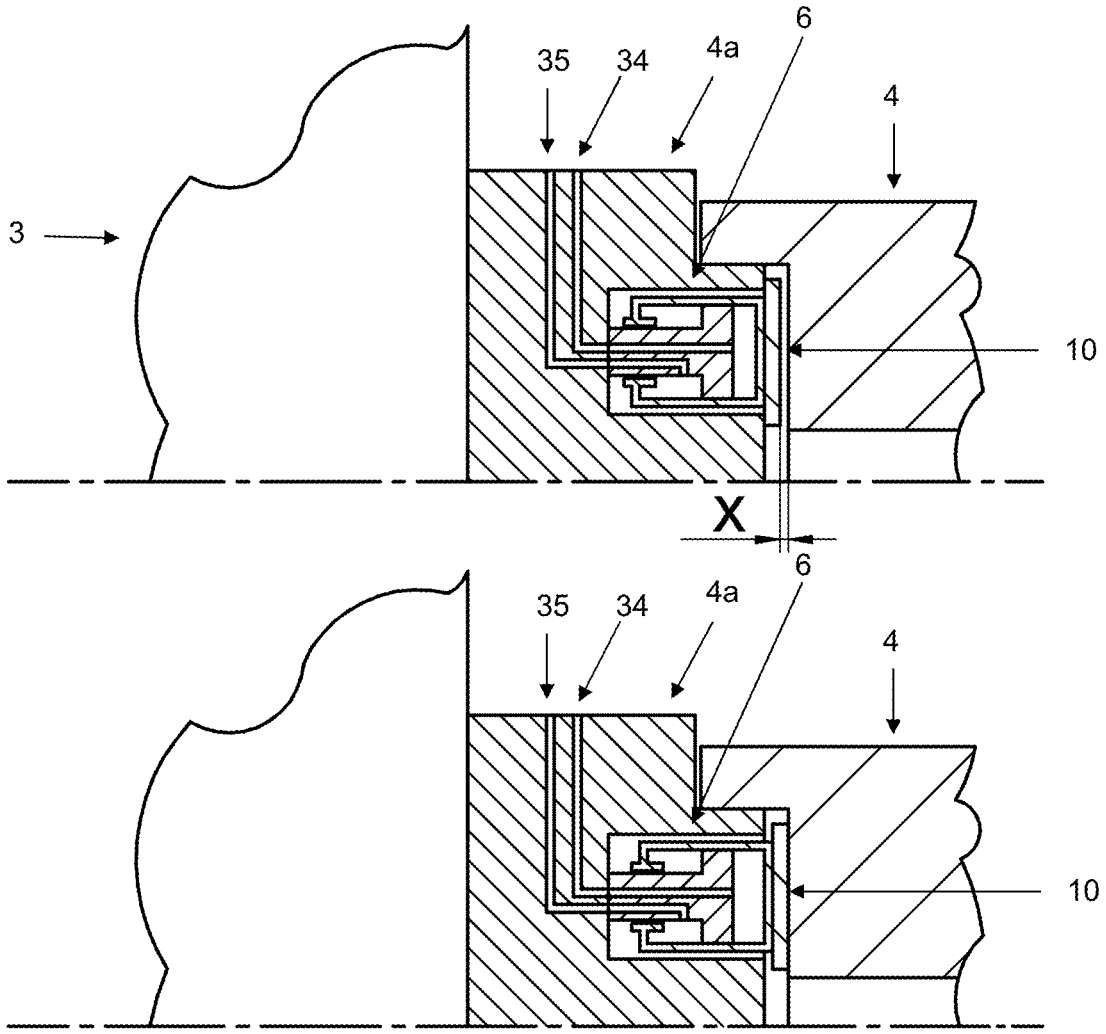
FIG. 9 shows a functional layout for a first hydraulic pressing unit in the retracted and extended state.

FIG. 9 shows the mode of operation of a first hydraulic pressing unit 6 in the retracted state (shown at the top) and in the extended state (shown at the bottom) on the basis of two half-sections. By applying pressure to the oil supply of the piston side 34, the pressure plate 10 moves to the right by the travel x. The piston rod is supported on the housing of the bending block 4*a* and only the cylinder barrel with the pressure plate 10 moves. This results in an especially compact structure, with the result that the piston and the piston rod can be easily integrated into the bending block 4*a*. In the extended state, the pressure plate 10 bears against the working roller chock 4, with the result that the working roller chock 4 with the working roller 1, which is not illustrated, the bending block 4*a* and the mill stand housing 3 are mechanically braced.

It is not important for the invention whether the bending blocks 4*a* in the mill stand housings 3 are vertically displaceable or are installed non-displaceably in the mill stand housings 3.

Although the invention has been illustrated and described in more detail by the preferred exemplary embodiments, the invention is not limited by the examples disclosed, and other variations can be derived therefrom by a person skilled in the art without departing from the scope of protection of the invention.

LIST OF REFERENCE SIGNS

1 Working roller
2 Back-up roller
3 Mill stand housing
4 Working roller chock
4*a* Bending block
5 Back-up roller chock
6 First hydraulic pressing unit
7 Second hydraulic pressing unit
8 Piston
9 Piston rod
10 Pressure plate
11*a* First oscillation absorber
11*b* Second oscillation absorber
14 Longitudinal bore
15 Helmholtz resonator
16 Longitudinal channel
17 Volume
19 λ/4 resonator
30 Mill stand
31 Rolling stock
32 Strip
33 HGC hydraulic cylinder
34 Oil supply, piston side
35 Oil supply, rod side
36 Leakage port
37 Lubricant supply
38 Proportional/regulating/servo valve or continuously adjustable valve
39 Switching valve
41 Pressure limiting valve
A, B Port of a hydraulic valve
C Hydraulic capacity
D1, D2, Diameter
D3
L Hydraulic inductance
HL Leakage port of the hydraulic system
HP Pressure port of the hydraulic system
HT Tank port of the hydraulic system
P Pressure port of a hydraulic valve
T Tank port of a hydraulic valve
TR Transport direction of the rolling stock
x Travel

The invention claimed is:

1. A mill stand having a device for stabilizing the working rollers and back-up rollers of the mill stand while a rolling stock is being rolled to form a strip, the mill stand comprising:

an upper and a lower working roller for rolling the rolling stock to form the strip, an upper and a lower back-up roller for supporting the working rollers in the mill stand, an operator-side and a drive-side mill stand housing, an operator-side and a drive-side working roller chock, the working rollers being rotatably mounted in the working roller chocks, operator-side and drive-side bending blocks for deflecting the working rollers, an operator-side and a drive-side back-up roller chock, the back-up rollers being rotatably mounted in the back-up roller chocks, wherein, for each bending block, there are at least two first hydraulic pressing units for stabilizing the working rollers in the mill stand housing, the first hydraulic pressing units being arranged upstream of the working roller in the transport direction of the rolling stock (TR), each first hydraulic pressing unit comprising a piston with a piston rod and a pressure plate, the piston and the piston rod being integrated in the bending block and the pressure plate being able to be pressed hydraulically against a working roller chock;

for each mill stand housing, there is at least one second hydraulic pressing unit for stabilizing the back-up rollers in the mill stand housing, the second hydraulic pressing unit being arranged downstream of the back-up roller in the transport direction of the rolling stock (TR), the second hydraulic pressing unit comprising a piston with a piston rod and a pressure plate, the piston and the piston rod being integrated in the mill stand housing and the pressure plate being able to be pressed hydraulically against the back-up roller chock, at least one of the first hydraulic pressing units contains a first oscillation absorber, which reduces pressure oscillations that occur in a pressure chamber of the at least one first hydraulic pressing unit.

2. The mill stand as claimed in claim 1, wherein at least one of the second hydraulic pressing units contains a second oscillation absorber, which reduces pressure oscillations that occur in a pressure chamber of the at least one of the second hydraulic pressing unit.

3. The mill stand as claimed in claim 2, wherein the first or second oscillation absorber is in the form of a Helmholtz resonator having a longitudinal channel forming a hydraulic inductance (L) and a volume forming a hydraulic capacity (C), the pressure chamber of one of the first hydraulic pressing units or the pressure chamber of one of the second hydraulic pressing units being connected to the longitudinal channel and the longitudinal channel being connected to the volume of the Helmholtz resonator.

4. The mill stand as claimed in claim 3, wherein the longitudinal channel has a settable throttle, with the result that the damping of the first or second oscillation absorber can be set.

5. The mill stand as claimed in claim 2, wherein the first or second oscillation absorber is in the form of a $\lambda/4$ resonator, the pressure chamber of one of the first hydraulic pressing units or the pressure chamber of one of the second hydraulic pressing units being connected to the $\lambda/4$ resonator.

6. The mill stand as claimed in claim 2, wherein the first or second oscillation absorber is in the form of a spring-mass oscillator.

7. The mill stand as claimed in claim 2, wherein $0.75*fT \leq fC \leq 1.33*fT$, wherein fC is a characteristic frequency occurring in the mill stand, and fr is a natural frequency of the first or second oscillation absorber.

8. The rolling stand as claimed in claim 2, wherein the piston rod of one of the first hydraulic pressing units and/or one of the second hydraulic pressing units has a first longitudinal bore being connected to a piston-side pressure chamber and a second longitudinal bore being connected to a rod-side pressure chamber.

9. The mill stand as claimed in claim 1, wherein the piston rod of one of the first hydraulic pressing units and/or one of the second hydraulic pressing units has a first longitudinal bore being connected to a piston-side pressure chamber and a second longitudinal bore being connected to a rod-side pressure chamber.

10. The mill stand as claimed in claim 1, wherein the piston rod of at least one of the first hydraulic pressing units is supported on one of the bending blocks and/or wherein the piston rod of at least one of the second hydraulic pressing units is supported on one of the mill stand housings.

11. A method for stabilizing the working rollers and back-up rollers of a mill stand, while a rolling stock is being rolled to form a strip in the mill stand, in particular by means of a device for stabilizing the working rollers and back-up rollers as claimed in claim 1, comprising the following method steps:

setting a rolling gap in the vertical direction between the lower and the upper working roller;

stabilizing the working rollers by applying a first hydraulic pressure to the first hydraulic pressing units, the first hydraulic pressing units being pressed against the working roller chocks;

stabilizing the back-up rollers by applying a second hydraulic pressure to the second hydraulic pressing units, the second hydraulic pressing units being pressed against the back-up roller chocks;

absorbing pressure oscillations in a pressure chamber of the first hydraulic pressing units by means of multiple first oscillation absorbers, absorbing pressure oscillations in a pressure chamber of the second hydraulic pressing unit by means of multiple second oscillation absorbers.

12. The method as claimed in claim 11, wherein the mill stand carries out three rolling passes in a finishing train and the first oscillation absorbers and a second oscillation absorbers are set to a natural frequency of between $f_{Low}$ and $f_{High}$

| nth rolling pass | $f_{Low}$ [Hz] | $f_{High}$ [Hz] |
|---|---|---|
| 1 | 22 | 40 |
| 2 | 48 | 87 |
| 3 | 75 | 133. |

13. The method as claimed in claim 12, wherein a pressing force of at least one of the first hydraulic pressing units during operation is set by way of a pressure regulator with a continuously adjustable valve.

14. The method as claimed in claim 11, wherein a pressing force of at least one of the first hydraulic pressing units during operation is set by way of a pressure regulator with a continuously adjustable valve.

15. The method as claimed in claim 14, wherein a pressing force of at least one of the second hydraulic pressing units during operation is set by way of a pressure regulator with a continuously adjustable valve.

16. The method as claimed in claim 11, wherein a pressing force of at least one of the second hydraulic pressing units during operation is set by way of a pressure regulator with a continuously adjustable valve.

* * * * *